US005785539A

United States Patent [19]

Ham et al.

[11] Patent Number: 5,785,539

[45] Date of Patent: Jul. 28, 1998

[54] PROTECTOR FOR CRT LEAD PIN

[75] Inventors: Sung-woo Ham, Seoul; Sung-soo Kim, Suwon, both of Rep. of Korea

[73] Assignee: Samsung Display Devices Co., Ltd., Kyungki-do, Rep. of Korea

[21] Appl. No.: 755,221

[22] Filed: Nov. 22, 1996

[30] Foreign Application Priority Data

Feb. 24, 1996 [KR] Rep. of Korea ..... 96-4408

[51] Int. Cl.[6] ..... H01R 13/44

[52] U.S. Cl. ..... 439/150

[58] Field of Search ..... 439/149, 150

[56] References Cited

U.S. PATENT DOCUMENTS

| | | | |
|---|---|---|---|
| 3,423,717 | 1/1969 | Klier et al. | 439/150 |
| 4,148,541 | 4/1979 | Marks | 439/150 |

FOREIGN PATENT DOCUMENTS

| | | |
|---|---|---|
| 0362979 | 4/1990 | European Pat. Off. . |
| 774190 | 5/1955 | United Kingdom . |
| 800180 | 8/1958 | United Kingdom . |

*Primary Examiner*—Neil Abrams
*Assistant Examiner*—T C Patel
*Attorney, Agent, or Firm*—Leydig, Voit & Mayer, Ltd.

[57] ABSTRACT

A protector for cathode ray tube (CRT) lead pins includes a cylindrical body having a central tubular portion with an inside surface, an outside surface surrounding the tubular portion, pin inserting holes concentrically arranged around the central tubular portion for receiving lead pins mounted on a neck portion of a CRT, and a flange portion extending circumferentially at one end of the body. At least the body or the flange includes opposed manually detectable position indicators for orienting the protector with respect to the lead pins of the CRT. The protector can be engaged with the lead pins accurately and rapidly.

8 Claims, 3 Drawing Sheets

PROTECTOR FOR CRT LEAD PIN

BACKGROUND OF THE INVENTION

The present invention relates to a cathode ray tube (CRT), and more particularly, to a protector for CRT lead pins which protects lead pins in a neck portion of a CRT.

In general, a CRT is comprised of a panel having a luminescent film on an inner surface and a funnel attached to the panel and having an electron gun and a deflection yoke inside and outside of a neck portion respectively. A plurality of lead pins are fixed to the end of the neck portion at predetermined intervals, for applying a predetermined voltage to each electrode of the electron gun.

The fixture of the lead pins to the end of the neck portion in the CRT causes the end of the neck portion to break when a slight external impact occurs and releases the lead pins from mutual isolation. Furthermore, a break at the end of the neck portion is likely to destroy the a vacuum state in the CRT.

In the prior art, to solve the above problems, a base cap 120 is installed to protect a fixing tube of a lead pin 110*a*, to which a high voltage is applied, among lead pins 110 of a neck portion 100 in a CRT, and a protector 10 covers the lead pins 110*a* and 110 against external impacts.

This protector 10 is provided with a cylindrical body 11 having a bored portion 11*a*, and a flange portion 12 extending radially at the outer surface of an end of the body 11. A plurality of pin inserting holes 11*b* and 11*c* are arranged around the cylindrical portion to correspond to the lead pins 110 and 110*a* in the body 11. The pin inserting hole 11*c* for inserting the lead pin 110*a* therein is distinguished from other pin inserting holes 11*b* by cut portions 11*d* cut along the length of the body 11 from both sides of the pin inserting hole 11*c*.

However, the conventional protector 10 as constituted above has the following problems: (1) due to the circular shape of the protector body, it takes a significant amount of time to accurately set the position for engaging the protector with the lead pins fixed to the neck portion; and (2) when the protector is inaccurately engaged with the lead pins, the intervals at which the lead pins are arranged are inconsistent, thus warping the lead pins or breaking the neck portion to which the bases of the lead pins are fixed. As a result, the vacuum state of the CRT can be lost.

SUMMARY OF THE INVENTION

The object of the present invention is to provide a protector for CRT lead pins which enables a rapid and easy setting of the position to combine lead pins with the protector.

To achieve the above object, there is provided a protector for CRT lead pins comprising a cylindrical body having a tubular center and having a plurality of pin inserting holes located concentrically around the tubular portion, for inserting lead pins of in a neck portion of the CRT, and a flange portion at one end of the body, wherein at least one of the body and the flange portion has means for setting a position for engaging the lead pins with the protector.

In the present invention, the position setting means is comprised of protrusions or concave portions formed at least one side of the surface of the body.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Figure 1:
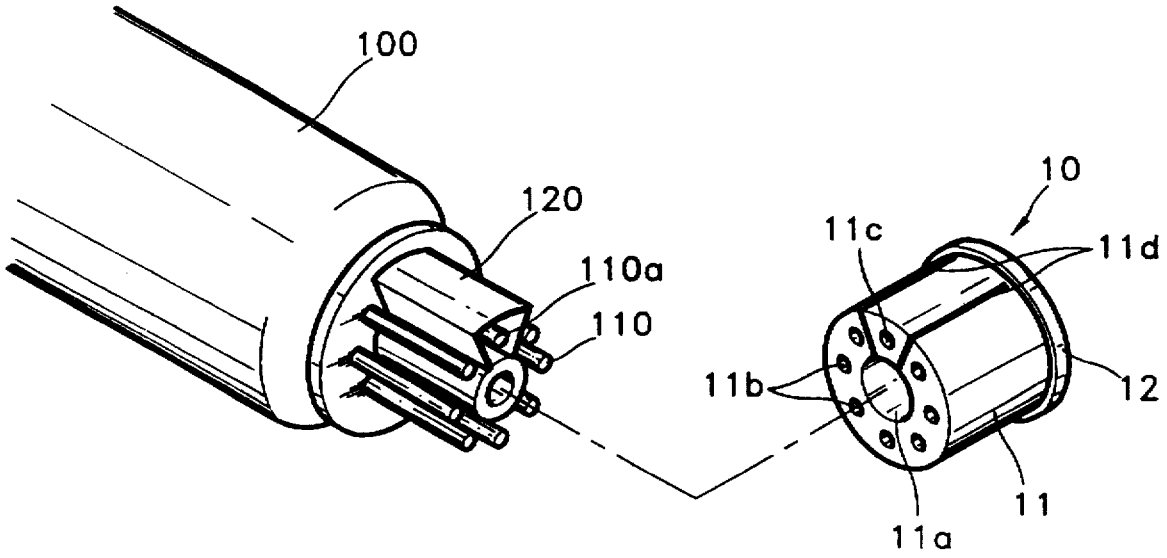
FIG. 1 (PRIOR ART)
FIG. 1 is an exploded perspective view showing a combination of lead pins installed in a neck portion of a CRT with a conventional protector.
Figure 2:
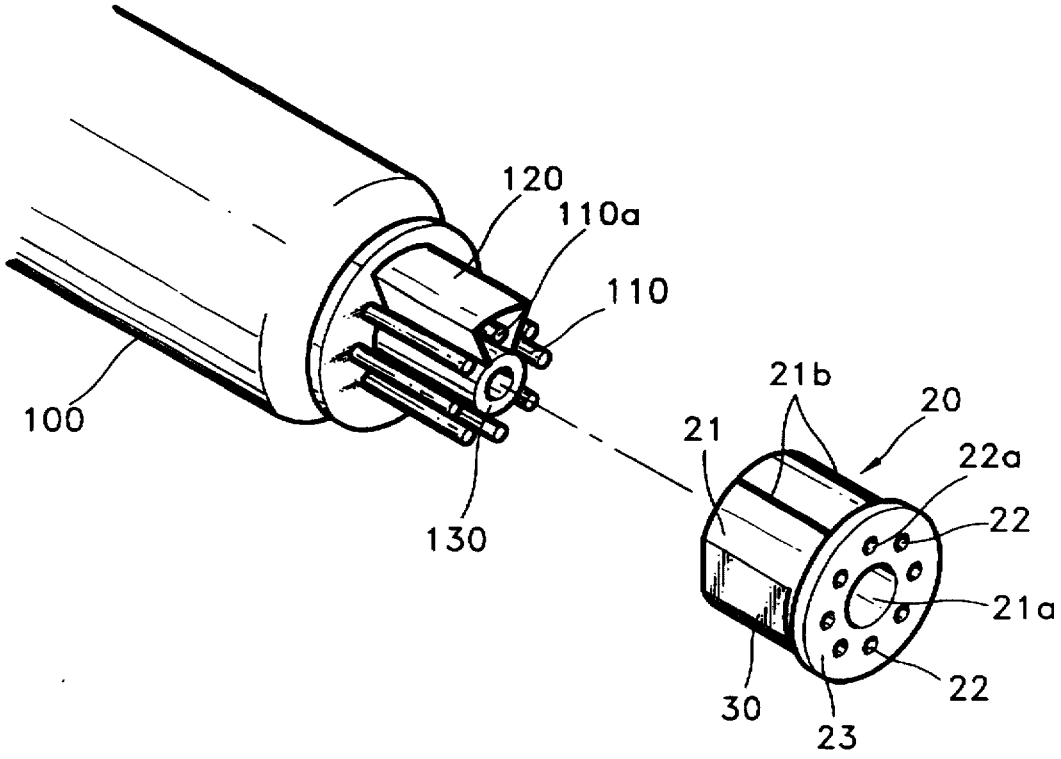
FIG. 2 is an exploded perspective view showing a combination of lead pins installed in a neck portion of a CRT with a protector according to the present invention.

In FIG. 2, like reference numerals denote the same elements as those of FIG. 1.

As shown in FIG. 2, a protector 20 according to an embodiment of the present invention is provided with a cylindrical body 21 having a tubular portion 21*a*, and a flange portion 23 extending radially from an end of the body 21. A plurality of pin inserting holes 22 and 22*a* are located in the body 21 to be combined with lead pins 110 and 110*a* fixed to a neck portion 100 of a CRT. The pin inserting holes 22 and 22*a* are arranged concentrically to correspond to the lead pins 110 and 110*a*. The pin inserting hole 22*a*, to which a high voltage is applied, is distinguished from the pin inserting holes 22 by a cut portion 21*b* formed along the length of the body 21 from both sides of the pin inserting hole 22*a*.

A position setting portion 30 is provided on the outer surface of the body 21, for setting a position to engage the protector 20 with the lead pins 110 and 110*a*. The position setting portion 30 has a flat surface, as shown in FIG. 2. Thus, an operator can rapidly and accurately set the engaging position by manually sensing the plane surface of the position setting portion 30.

In FIG. 2, reference numeral 130 denotes a stem to be inserted into the tubular portion 21*a* of the body 21.

Figure 3:
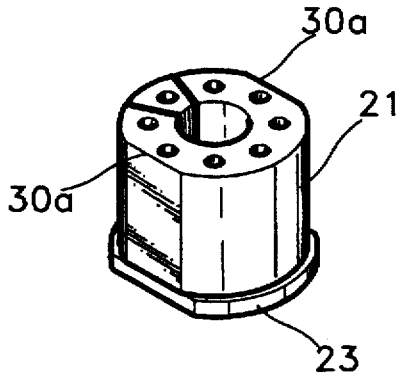
FIG. 3 illustrates another embodiment embodiments of the protector according to the present invention.

The position setting portion may have plane surfaces 30*a* at both sides of the body 21 and the flange 23, as shown in FIG. 3.

Figure 4:
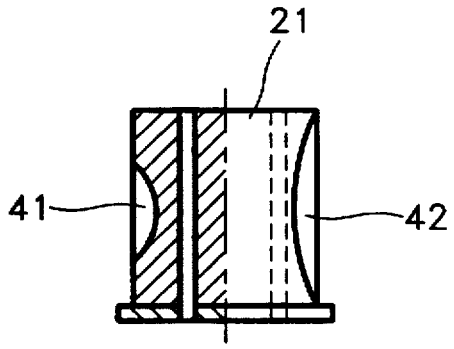
FIG. 4 depicts yet another embodiment of the protector according to the present invention.

As shown in FIG. 4, concave portions 41 and 42 preferably having different radii of curvature may be formed at both sides of the body 21 of the protector, according to a third embodiment of the present invention.

Figure 5:
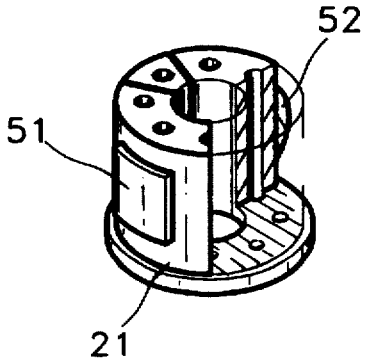
FIG. 5 shows still another embodiment of the protector according to the present invention.

According to a fourth embodiment of the present invention, protrusions 51 and 52 may be formed at opposing sides of the outer surface of the body, as shown in FIG. 5. These protrusions 51 and 52 are preferably different in configuration so that the operator can easily sense the combining position manually. Here, the end portions of the protrusions 51 and 52 are preferably hemispherical. The number of the protrusions 51 and 52 may vary.

Figure 6:
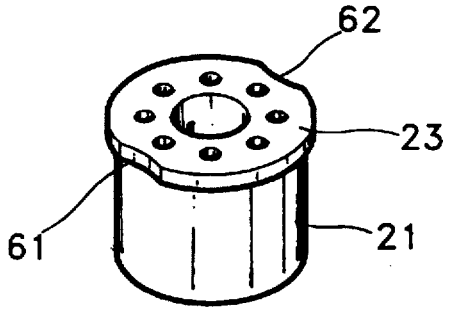
FIG. 6 illustrates an alternate embodiment of the protector according to the present invention.

According to a fifth embodiment of the invention, the position setting portion in the protector of the present invention may include grooves 61 and 62 formed at opposing sides of the flange portion 23, as shown in FIG. 6. The grooves 61 and 62 can be located in one side of the flange portion 23, and grooves 61 and 62 may be different in size.

Figure 7:
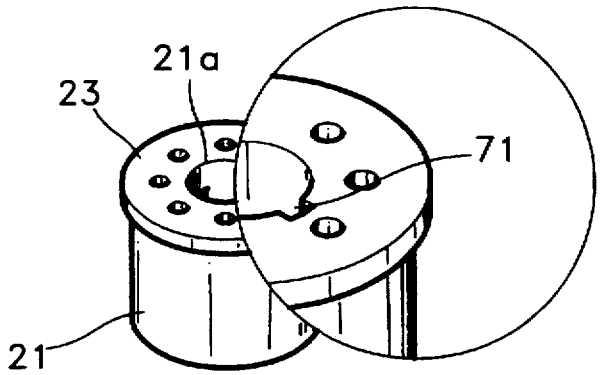
FIG. 7 depicts still another embodiment of the protector according to the present invention.
Figure 8:
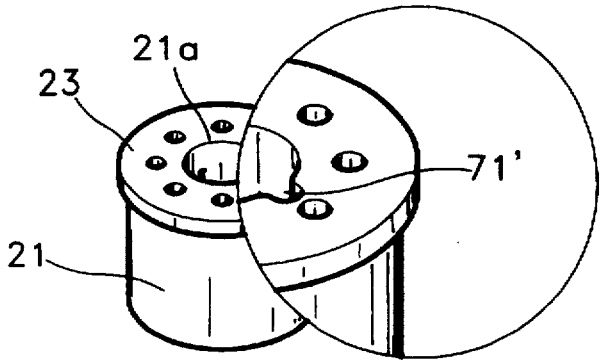
FIG. 8 shows yet another embodiment of the protector according to the present invention.

According to a sixth embodiment of the invention, the position setting portion may include a square groove 71 or a circular groove 71' formed at the inner circumferential edge of the flange portion 23, as shown in FIGS. 7 and 8 respectively. The groove 71' may be curved.

Though the hollow portion 21*a* is circular, it can be made elliptical to serve as a position setting portion of the protector.

The engaging position of the protector is established by manually sensing the grooves 71 and 71'.

By using the position setting portions for the protector as described above, the position for engaging the protector with the lead pins can be set with the following advantages:

(1) The protector can be engaged with the lead pins easily and rapidly, since the protector engaging position can be manually sensed. From a test by the present inventor, it is noted that the time for engaging the protector was reduced by 50% or more; and (2) Warping of the lead pins and breaking off of the neck portion are prevented by accurately engaging the lead pins with the protector, thereby markedly reducing product failures and material cost.

The protector for CRT lead pins according to the present invention is not restricted to the above embodiments, and it is clearly understood that many variations are possible within the scope and spirit of the present invention by anyone skilled in the art.

For example, grooves or protrusions can be located at both sides of the body of the protector.

What is claimed is:

1. A protector for cathode ray tube (CRT) lead pins comprising a substantially cylindrical body having a central tube with an inside surface, an outside surface surrounding the inside surface, a plurality of pin inserting holes arranged concentrically around the central tube between the inside and outside surfaces for receiving respective lead pins mounted on a neck portion of a CRT, and a flange located at and extending circumferentially from one end of said body, wherein said body comprises first and second concave portions in the outside surface of said body.

2. The protector for CRT lead pins as claimed in claim 1, wherein the first and second concave portions have different radii of curvature.

3. A protector for cathode ray tube (CRT) lead pins comprising a substantially cylindrical body having a central tube with an inside surface, an outside surface surrounding the inside surface, a plurality of pin inserting holes arranged concentrically around the central tube between the inside and outside surfaces for receiving respective lead pins mounted on a neck portion of a CRT, and a flange extending circumferentially from one end of said body, wherein said flange includes, in an outer circumference, concave cutouts.

4. The protector for CRT lead pins as claimed in claim 1, wherein the first and second concave portions are on opposite sides of said body.

5. The protector for CRT lead pins as claimed in claim 2, wherein the first and second concave portions are on opposite sides of said body.

6. The protector for CRT lead pins as claimed in claim 3, wherein the cutouts have different sizes.

7. The protector for CRT lead pins as claimed in claim 3, wherein the cutouts are located on opposite sides of the central tube.

8. The protector for CRT lead pins as claimed in claim 6, wherein the cutouts are located on opposite sides of the central tube.

* * * * *